US005228723A

United States Patent [19]

Hertig

[11] Patent Number: 5,228,723

[45] Date of Patent: Jul. 20, 1993

[54] VALUE TOKEN CHIP CARRIER

[75] Inventor: Michael Hertig, Berlin, Fed. Rep. of Germany

[73] Assignee: International Marketing Corporation, Wilmington, Del.

[21] Appl. No.: 716,772

[22] Filed: Jun. 18, 1991

[30] Foreign Application Priority Data

Jun. 25, 1990 [DE] Fed. Rep. of Germany ... 9007044[U]

[51] Int. Cl.[5] ..... B42D 15/00

[52] U.S. Cl. ..... 283/100; 283/51; 283/56

[58] Field of Search ..... 283/51, 100, 56

[56] References Cited

U.S. PATENT DOCUMENTS 1,130,832 3/1915 Maher ..... 283/51
2,213,666 9/1940 Burke ..... 283/100 X
4,235,459 11/1980 Callahan ..... 283/114

*Primary Examiner*—Paul A. Bell

[57] ABSTRACT

Value token chip carrier, preferably of credit card format, comprising a card body (11), provided with a plurality of embossed rebates (12), into which value token chips (13) are integrated, detachably held by connection means. The value token chips (13) and the card body (11) are provided with a continuous, flush advertising carrier surface (20).

3 Claims, 1 Drawing Sheet

VALUE TOKEN CHIP CARRIER

BACKGROUND AND FIELD OF THE INVENTION

The invention relates to a value token chip carrier, preferably of credit card format, comprising a card body, provided with a plurality of embossed rebates, in which value token chips are integrated, detachably held by connection means.

Value token chip carriers of this type are known as an accountancy aid from U.S. Pat. No. 1,130,832. Likewise, credit cards are known which permit cashless monetary transactions. Such monetary transactions can, however, only be performed by a legally competent person and the acquisition of the required skills takes some time. Practising such skills should therefore commence and be attractive during infancy and youth.

A need exists for a credit instrument, similar to a credit card, the portions of which, unused for monetary transactions, may be put to a further, attractive use.

GENERAL DESCRIPTION OF THE INVENTION

The present invention provides a value token chip carrier as set out in the opening paragraph, wherein the value token chips and the card body are provided with a continuous, flush advertising carrier surface. Due to these measures, such a value token chip carrier may simultaneously be used for advertising products dependent or independent of the card contents. Also, a quasi credit card is created which does not require an expensive debit entry and allows a cash-like monetary transaction. In an embodiment, especially intended for rather young or illiterate consumers, it is contemplated that the value token chips embody the outlines of popular products and are provided with recesses, that the card body in the region of the embossed rebates is provided with support webs and that the recesses and support webs are interengaged in snap fashion.

The value token chips may thus be connected to the card body in a reinsertable manner, it being provided that the value token chips comprise recesses and the carrier body comprises webs in the region of the embossed rebates. They may, however, also be irreversibly fixed to the card body for single use only, for which purpose the carrier body and the value token chips are manufactured as one integral part interconnected by predetermined breaking points.

To broaden the field of use, it is provided that the card body and/or the value token chips are provided with one or more advertising carrier surfaces, which are fixed to the card body by way of an adhesive layer or are printed onto the card body.

Further advantageous measures are described below. The invention is illustrated in the accompanying drawing by way of a working example and will now be described in more detail.

DESCRIPTION OF SPECIFIC EMBODIMENTS

Figure 1:
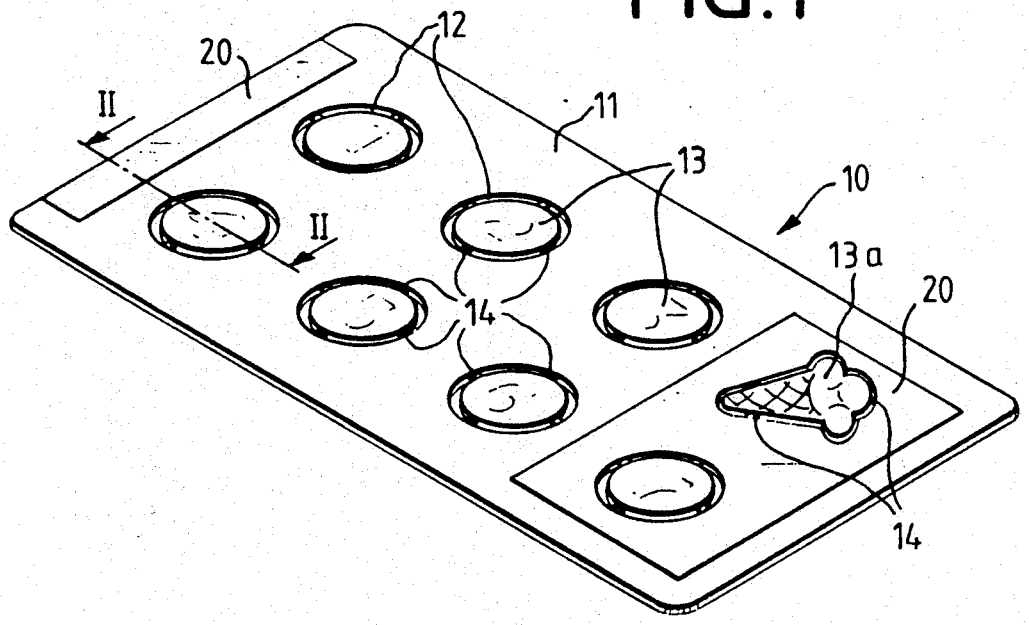
FIG. 1 represents an isometric view of a credit card according to the invention comprising a plurality of preembossed value token chips in embossed rebates.

The credit card 10 consists essentially of a card body 11, provided with a plurality of openings or embossed rebates 12. The openings or embossed rebates 12 accommodate an equal number of value token chips 13 which, by means of predetermined breaking points 14, are integrally connected to the card body 11. The value token chips **13*a*** may also embody the outlines of popular, typical children or juvenile commercial products, for example a hamburger or an ice-cream cone.

Figure 2:
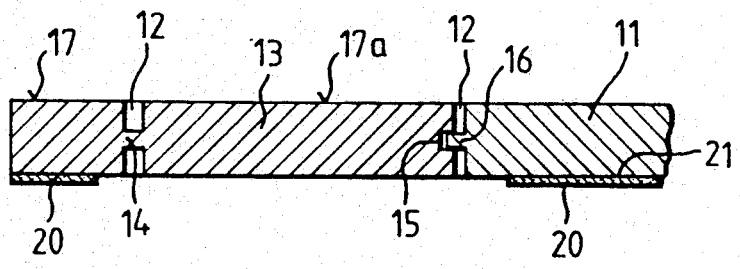
FIG. 2 represents a section through the card body along the section line II—II in FIG. 1.

As is shown in FIG. 2, the card surface 17 and the chip surfaces **17*a* are flush. The card body 11 and the value token chips 13 are made of plastics material, preferably hard plastics. The value token chips 13, as illustrated in FIG. 2 on the left-hand side, are integrally connected to the card body 11 via a plurality of predetermined breaking points 14/14*a*. In order to prevent injury to the card holder, these predetermined breaking points are so designed that the holding webs 14*a* are retained on the value token chip 13 while the openings or embossed rebates 12 of the card body 11** are entirely smooth walled.

Figure 3:
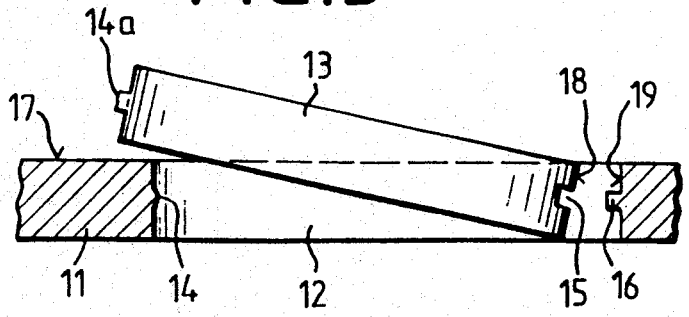
FIG. 3 represents a section through a card body according to FIG. 1 showing a value token chip, detachable by means of a snap connection, during its removal.

In a different embodiment, as illustrated in FIG. 3, the value token chips 13 are provided with an all-around recess 15, adapted to be brought into snap engagement with corresponding support webs 16 of the card body 11. The recesses 15 are for this purpose provided in the narrow side edges 18 of the value token chips 13 along outlines which may be designed square or circular or depicting a commercial product **13*a***.

On the inner edges 19 of the openings or embossed rebates 12 support webs 16 are provided which correspond with the recesses 15. By means of such a detachable snap connection, a value token chip 13 may be brought repeatedly into interengagement with and be released again from the card body 11.

If it is desired that the value token chips 13 should be removed once only, these may be connected integrally with the card body 11 by means of predetermined breaking points 14, designed as hard plastics webs. The value token chips may be easily pushed out of the openings are embossed rebates 12 of the card body 11.

The card body 11 may be provided with one or more advertising carrier surfaces 20 which may serve as carrier for advertisements or instructions for use. The advertising carrier surfaces 20 may be fixed to the card body 11 by means of an adhesive layer 21 or take the form of a transfer picture. The advertising carrier surface 20 may also be printed onto the card body 11 and/or the value token chips 13 or the product displays **13*a***.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is:

1. Value token chip carrier comprising a card body provided with a plurality of openings and a value token chip (13, **13*a*) being detachably retained in each opening, said value token chips (13) and said card body (11) each having a flat upper advertising carrying surface, said flat upper advertising carrying surfaces being coplanar, and the value token chips (13) are provided with a recess (15) extending all-around their side edges (18) the card body (11) being provided with support webs (16) and the recess (15) and the support webs (16**) being interengaged in snap fashion.

2. Value token chip carrier comprising a card body provided with a plurality of openings and a value token chip (13, 13*a*) being detachably retained in each opening, said value token chips (13) and said card body (11) each having a flat upper advertising carrying surface, said flat upper advertising carrying surfaces being coplanar, said card body and said value token chips being integrally formed from a hard plastic material, the value token chips (13) being shaped in the outlines of popular commercial products (13*a*) and the value token chips being provided with recesses (15), the card body (11) being provided with support webs (16) and the recesses (15) and the support webs (16) being interengaged in snap fashion.

3. Value token chip carrier comprising a card body provided with a plurality of openings and a value token chip (13, 13*a*) being detachably retained in each opening, said value token chips (13) and said card body (11) each having a flat upper advertising carrying surface, said flat upper advertising carrying surfaces being coplanar, and a plurality of recesses (15) is provided on each said value token chip (13), distributed over the circumference of the side edge (18), the card body (11) being provided with support webs (16) and the recesses (15) and the support webs (16) being interengaged in snap fashion.

* * * * *